US006318725B1

(12) United States Patent
Saint-Victor

(10) Patent No.: US 6,318,725 B1
(45) Date of Patent: Nov. 20, 2001

(54) GAME JACKS HAVING INDICIA THEREON AND METHOD OF PLAY

(76) Inventor: Emmanuel Saint-Victor, P.O. Box 450991, Atlanta, GA (US) 31145

( * ) Notice: Subject to any disclaimer, the term of this patent is extended or adjusted under 35 U.S.C. 154(b) by 0 days.

(21) Appl. No.: 09/204,455

(22) Filed: Dec. 3, 1998

(51) Int. Cl.[7] ..... A63F 9/07
(52) U.S. Cl. ..... 273/447; 273/146
(58) Field of Search ..... 273/146, 440, 273/447

(56) References Cited

U.S. PATENT DOCUMENTS 1,542,031 * 6/1925 Bruhn .
2,987,833 * 6/1961 Stolpen .
3,670,427 * 6/1972 Stolpen .
4,778,392 * 10/1988 Mitchell .
4,874,175 * 10/1989 Fischer .
4,902,022 * 2/1990 Salmon .
4,986,539 * 1/1991 Jackson .
5,125,660 * 6/1992 Stahl .
5,863,204 * 1/1999 Fulton .

* cited by examiner

*Primary Examiner*—William M. Pierce
(74) *Attorney, Agent, or Firm*—Barry E. Kaplan, Esq.; Hughes & Kaplan

(57) ABSTRACT

A challenging and patience developer toy for two or more players. This invention relates to four six-sided Jacks and a ball, specifically to a kind of Jacks marked with words, letters, numbers, and suits attributes so that the Jacks can be used during the game where the markings showings on the upper surfaces of the Jacks after being thrown will instruct the player either to follow the pinnacle of the game or to do some other activities described later on in the summary of the game. The game begins by holding all four trapezoidal Jacks in one hand. Turn hand over and gently drop Jacks onto playing surface. The object of the game is to drop the ball pick up the Jacks, then catch the ball with the same hand. Let the ball hit the surface only once. Begin game by picking up only one Jack, then two, then three, then four. The rule of the game is to do the repetition of this numerically increasing activity for side A, then side B, then side C, then side D. Working your way to the pinnacle of the competition. There will be times when the player drops the Jacks and the markings showing up in the Jacks read an instruction to "SKIP ONE OR TWO STAGES", to "GO BACK ONE OR TWO STAGES", to "MAKE FUN OF YOURSELF" or even announce that "YOU WIN IT ALL". These instructions do add tremendous fun and challenges to the game.

12 Claims, 9 Drawing Sheets

PERSPECTIVE VIEW OF JACKS

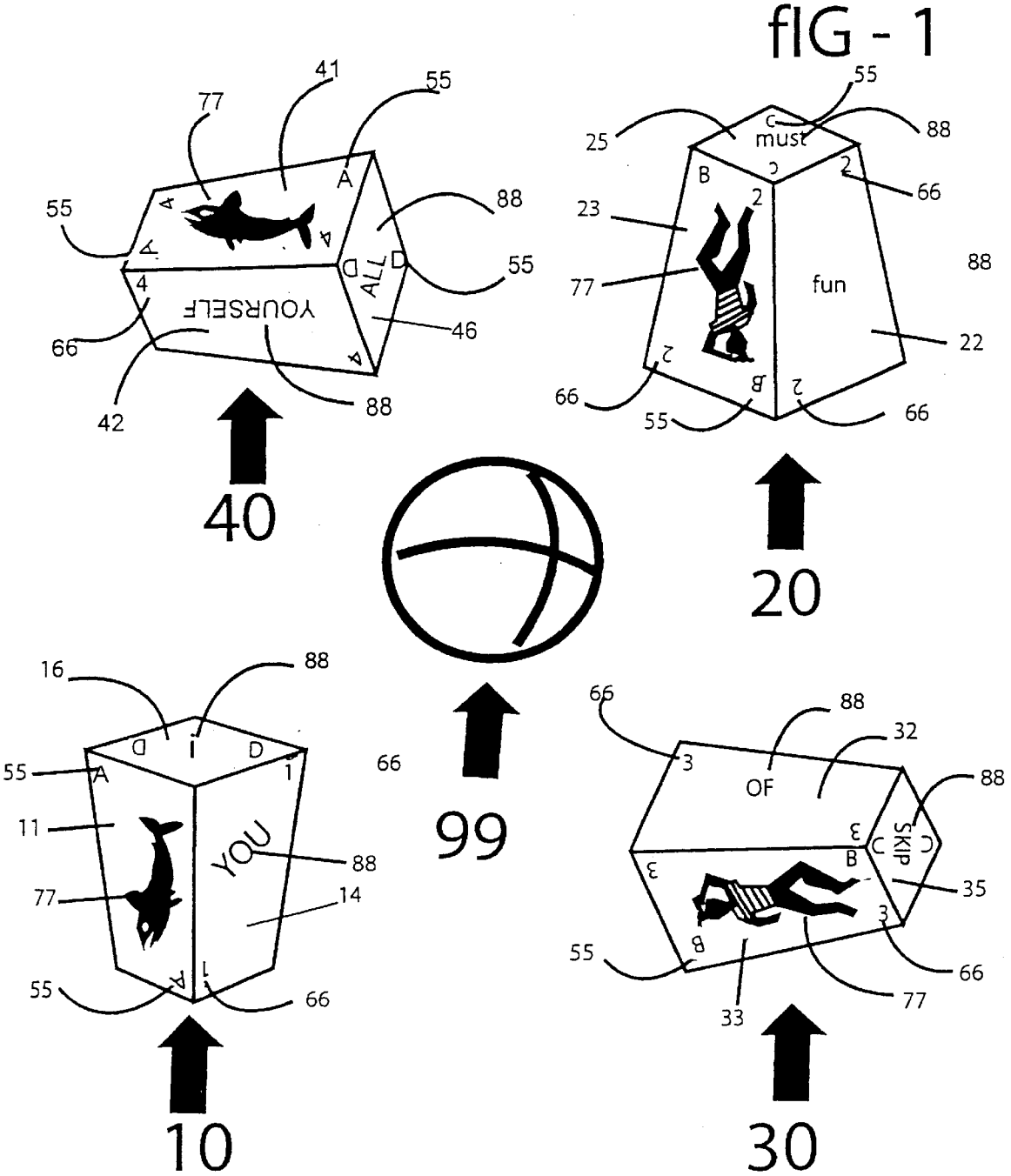
PERSPECTIVE VIEW OF JACKS

MARKINGS ON FACES OF JACK 10

MARKINGS ON FACES OF JACK 20

MARKINGS ON FACES OF JACK 30

MARKINGS ON FACES OF JACK 40

JACK 10
JACK 20
JACK 30
JACK 40

FACE 4
MAKE
FUN
OF
YOURSELF
14
24
34
44
66
88

FACE 5
I
MUST
SKIP
1-STAGE
15
25
35
45
55

FACE 6
I
WIN
IT
ALL
16
26
36
46

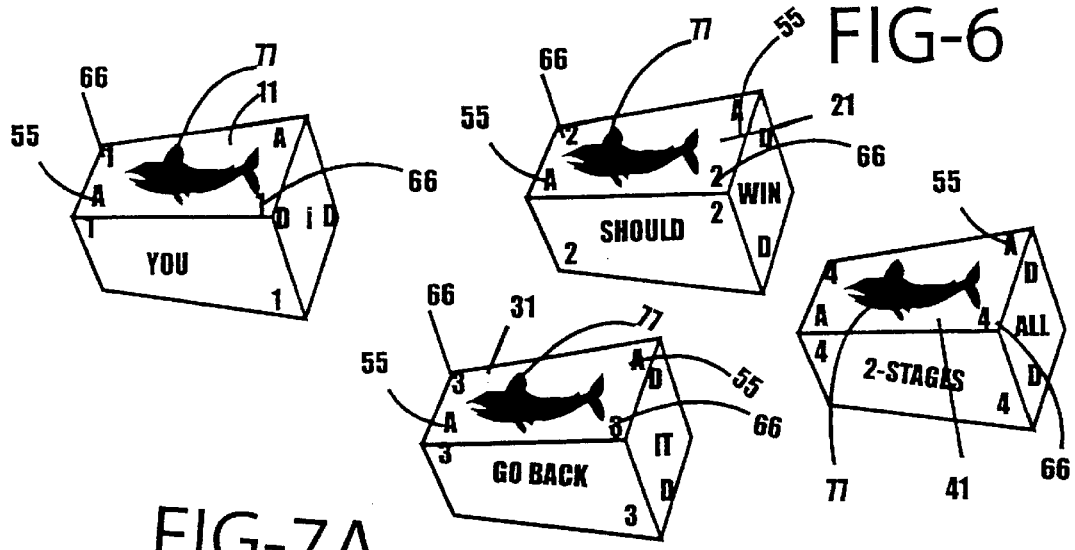
FIG-6
FIG-7A
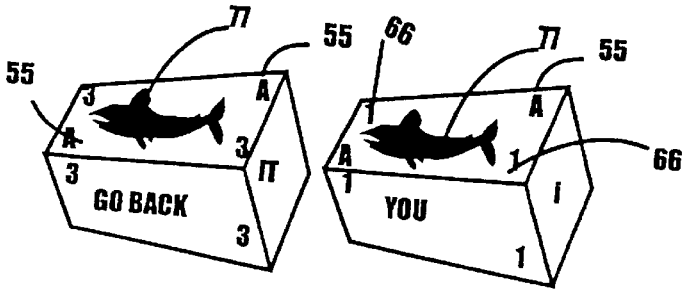
FIG-7B
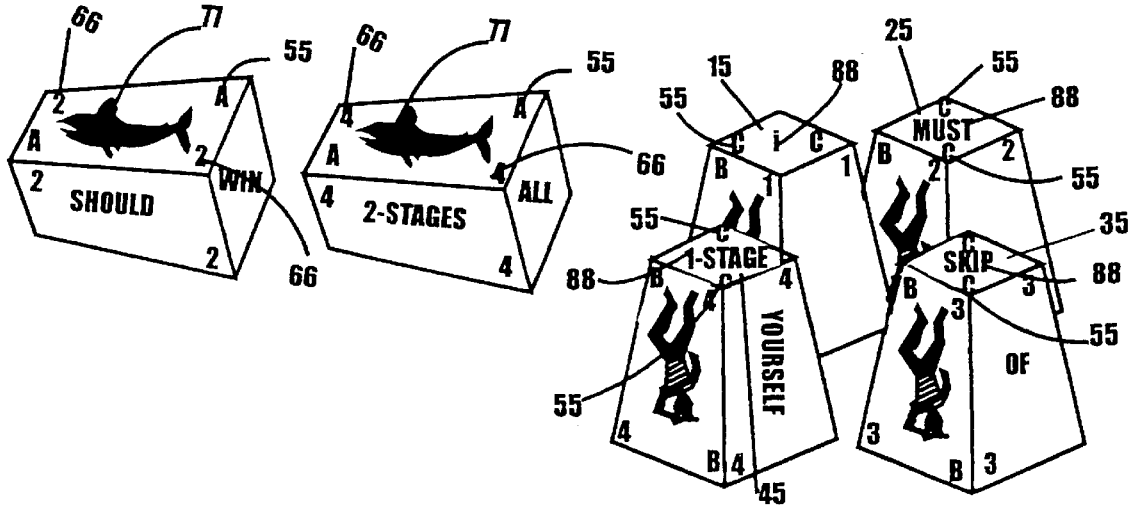

GAME JACKS HAVING INDICIA THEREON AND METHOD OF PLAY

BACKGROUND OF THE INVENTION

Jacks or Jackstone have been long played by children. It's been a game in which pieces of metal or pebbles are tossed up and caught in various ways. Each player bounces the ball and picks up the Jacks in between bounces.

Although, Jacks game is enjoyable it is still a children game. There is no challenges after a few minutes of playing and also there is no surprise for an experienced player.

It is desirable to provide a Jacks game which attracts all ages and gender attention.

It is desirable to provide a Jacks game that challenges dexterity and coordination of a player against any opponents.

It is finally desirable to provide a Jacks game in which the markings on the faces of the Jacks give instructions to the player or to the opponents either to skip, to go back, to make fun of him/herself or even announce that he/she wins the game.

SUMMARY OF THE INVENTION

The inadequacies of the prior Jacks game have been resolved by the present invention. This Jacks game includes four plastic trapezoidal Jacks and a rubber ball. Each Jack has six sides. Each Jack is presented as the bottom portion of a truncated pyramid. Therefore, the four regular sides are not parallel but the smaller base and the larger base are formally parallel. One side of each Jack is marked on the upper left and lower right corners with a literal indicia "A", another side is marked with "B", the smaller base is marked with "C" and the larger base is marked with indicia "D". These literal indicia determine the sequence to follow during the game.

Place the four Jacks in front of you in a plane surface so as to have the A-faced up. Set them side by side and in ascendant numerical indicia. You see face 1A, face 2A, face 3A, face 4A. The literal indicia which is "A" in this side of the Jacks are marked on the upper left corners and the lower right corners of the trapezoidal Jacks. While, the upper right comers and the lower left comers are marked with numeric indicia: 1, 2, 3, or 4. The numeric indicia distinguish each Jack. So, there is Jack 1, Jack 2, Jack 3, Jack 4. The center of the A-faced side carries a suit. In this illustration it is a fish, which had been chosen arbitrarily.

Turn the Jacks to their next possible right side. You can see Jack I has the word "YOU" marked in it's central portion. Jack 2 carries the word "SHOULD," Jack 3 has the word "GO BACK" and Jack 4 contains the words "2-STAGES". These words combine in a sentence form "YOU SHOULD GO BACK 2-STAGES" these regular sides of the Jacks with words do not have literal indicia. They do not follow any particular sequence in the game. They are created to complete within themselves that sentence or to be interchanged among other faces to create other sentences that give different instructions to the players.

Turn the Jacks to their next possible right faces, the disposition is analogous to the A-faced Jacks. The upper left and lower right corners are marked with the literal indicia "B" which indicate that this is the second face to show up and to be picked up in the pinnacle of the competition. The upper right and the lower left corners carry the numerical indicia: 1, 2, 3, or 4. And the central portion of the Jacks has a suit. In this case, it is a dancer which also had been chosen arbitrarily.

Finally, turning the Jacks to their last next right sides, you realize that it is also analogous to the second phase of our demonstration. Jack 1 is marked with the word "MAKE" in its center. Jack 2 carries the word "FUN", Jack 3 contains the word "OF" and Jack 4 has the words "YOURSELF". These words together form the sentence "MAKE FUN OF YOURSELF". The upper left and lower right comers do not contain any literal indicia. These sides of the Jacks like in the second phase do not follow the sequence of the pinnacle of the competition. They are created to complete among themselves that sentence or interchange with other faces to give different instructions. However the upper right and lower left corners have the indicia: 1, 2, 3, or 4 which differentiate each Jack from the other Jacks.

Now, place the larger bases of the Jacks over the plane surface and let the smaller bases be faced up. You can see Jack 1 has the word "I", Jack 2 has the word "MUST", Jack 3 is marked with "SKIP" and Jack 4 contains the word "I-STAGE". Combine these words together you have "I MUST SKIP 1-STAGE". Two opposite corners of these faces are marked with indicia "C" which indicate that this is the third stage in the regular sequence of the pyramid of the game. Unlike the four regular sides, the smaller bases are not marked with any numerical indicia.

And, the final faces of the trapezoidal Jacks consists in flipping the four Jacks so that the larger bases can be faced-up. The disposition of these sides is analogous to the prior phase or the smaller bases. The central portion of Jack 1 is marked with the word "I", Jack 2 contains the word "WIN", Jack 3 carries the word "IT" and Jack 4 has the word "ALL". Combine in a sentence they form, "I WIN IT ALL". Two opposite comers are marked with indicia "D" which explains that this is the fourth stage of the game or the one that follows the "C" stage. Like the smaller bases, the larger bases are not marked with any numerical indicia.

The game also includes a small rubber ball approximately one inch in diameter. The ball marks the tempo of the game or let's say the ball is the catalyst of the game.

The game is easy to learn, yet challenging to master. The game begins with a player holding all four trapezoidal Jacks in one hand. Turn hand over and gently drop Jacks onto playing surface. The object of the game is to drop the ball, pick up the Jacks, then catch the ball with the same hand. Let the ball hit the surface only once. They are four stages in the game designated by the four literal indicia. The player needs to start with the sides carrying the literal "A", then the "B", then the "C" and finally the "D". If there is no A-faced Jack, then the player must flip each Jack onto its "A" side, catch the ball, drop the ball back, and then pick up the Jack and then catch the ball once again. Dropping the ball once again the player then picks up another A-faced Jack. This process continues for each of the four Jacks. If the player fails to catch the ball or handle the Jacks accordingly, then he/she loses the turn and must turn over the Jacks and ball to the next player. The rule of dropping the Jacks and catching the ball applies throughout the remainder of the game.

The next challenge is to pick up a set of two A-faced Jacks. There arc two two sets of A-faced Jacks in total.

If the player accomplishes this task, he/she must pick up an A-faced Jack, followed by a set of three A-faced Jacks. Finally to complete the first stage of the game the player must pick up all four A-faced Jacks in one gathering.

The second stage of the game will consist of the repetition of this numerically increasing activity using B-faced Jacks and then the third stage is doing it over with C-faced Jacks and finally the player must go through the same repetition for the D-faced Jacks to complete the pinnacle of the game.

Thus, so far the game is challenging, the most exciting moment of the game will be demonstrated in the illustrations that follow. Throughout the game, the dropping of the Jacks is very important to the player which dropped the ball and also to the opponents. This is the time that surprises arise. The sentences that were formed by combining the words in our illustrations earlier have meaningful contributions to the challenges of the game. They communicate either an advantage or a loss to the player that dropped the ball or to the opponents. For example, where we had "I MUST SKIP 1-STAGE", instructs the player to omit one stage in the pyramid of the game. If the Jacks read that sentence after the successful pick up of a step four A-faced (4 Jacks×1 time) gathering then the player instead of following the sequence of the game which will dictate to pick up four ones B-faced (1 Jack×4 times) Jacks will jump to the four ones pick up of the "C" stage (1 C-faced Jack×4 times). However if the Jacks read "YOU MUST SKIP 1-STAGE". The next player (or the opponent if only played by 2 players) will skip one-stage during his turn. Now let's say the player were on his/her final stage playing for the D-faced Jacks, the player would have to skip this stage and go to A-faced Jacks which put he/she back just where he/she had started. Therefore this player would have missed this opportunity to win the game.

However, without any consideration of your position in the sequence of the game, if dropping the Jacks they form the sentence "I WIN IT ALL" this particular game is over. The player that dropped the Jacks is the winner. If instead, the Jacks read "YOU WIN IT ALL" the next player wins it.

There will be instances when the Jacks read MAKE FUN OF YOURSELF in which the player is instructed to say or do something about him/herself that can make other players laugh. YOU MUST SKIP 2-STAGES, I MUST GO BACK 1-STAGE, and a lot of other sentences that could be formed by interchanging words in dropping Jacks. Players will be able to discover while playing, numerous sentences that give instructions and create fun and challenges in the game.

BRIEF DESCRIPTION OF THE DRAWING

The various features and other uses of the present invention will become more apparent by referring to the following detailed description and drawing in which:

FIG. 1 is a perspective view of the preferred embodiment of the four Jacks and the ball. It shows the arrangement of the markings on the faces of the four Jacks.

FIG. 6 is another view of an arrangement of the four Jacks of the invention ready to be picked, during the third step of the first stage of the game.

FIG. 7A and FIG. 7B show two arrangements of the four Jacks ready to be picked.

REFERENCES AID

Figure 2A:
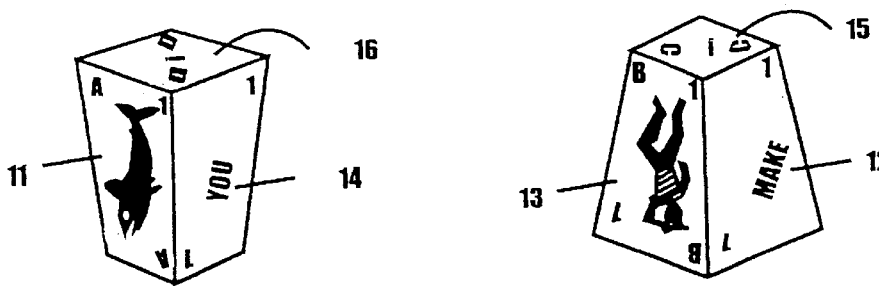
FIG. 2A through FIG. 2D show the markings on the six faces of each Jack taken individually.

| | |
|---|---|
| BALL | 99 |
| SUITS | 77 (Fish, Dancer) |
| WORDS | 88 |
| LETTERS (Literal Indicia) | 55 (A, B, C, D) |
| NUMBERS (Numeric Indicia) | 66 (1, 2, 3, 4) |
| JACK #1 | 10 |
| JACK #2 | 20 |
| JACK #3 | 30 |
| JACK #4 | 40 |

| Sides (Faces of Jacks) | JACK #1 | JACK #2 | JACK #3 | JACK #4 |
|---|---|---|---|---|
| Regular side (1st) | 11 | 21 | 31 | 41 |
| Regular side (2nd) | 12 | 22 | 32 | 42 |
| Regular side (3rd) | 13 | 23 | 33 | 43 |
| Regular side (4th) | 14 | 24 | 34 | 44 |
| Smaller base | 15 | 25 | 35 | 45 |
| Larger base | 16 | 26 | 36 | 46 |

1 stage: 4 phases (or steps)

phase 1: pick 1 Jack × 4 times
phase 2: pick 2 Jacks × 2 times
phase 3: pick 1 Jack + 3 Jacks
phase 4: pick 4 Jacks × 1 time
4 stages: A, B, C, D

DESCRIPTION OF THE PREFERRED EMBODIMENTS

Throughout the following description and drawing, an identical reference numeral is used to refer to the same component shown in multiple figures of the drawing. (As a Guide, refer to the table shown above: "References Aid".

Referring now to the FIG. 1 in particular is depicted a six-sided Jacks game with words, numerical, literal and suits attributes toy which challenges dexterity and coordination while being very amusing during use.

Figure 2B:
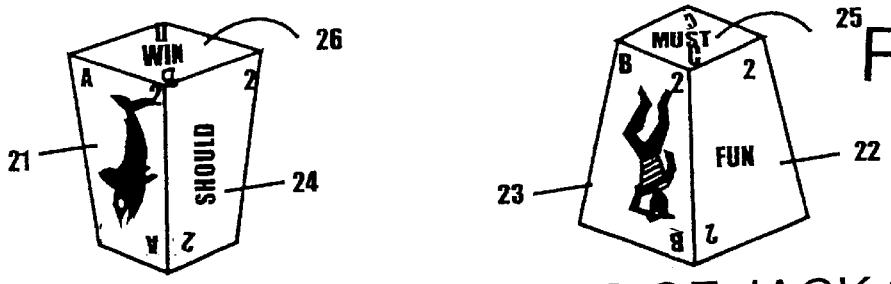
Figure 2C:
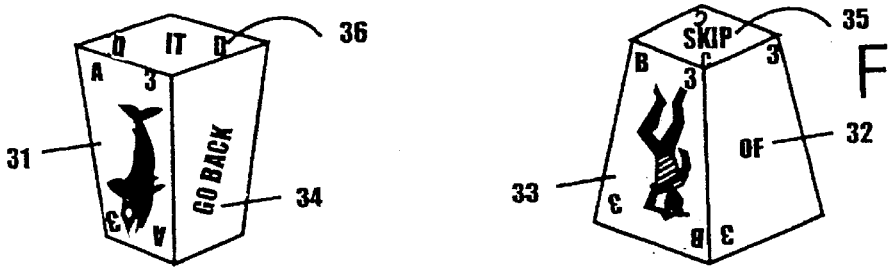
Figure 2D:
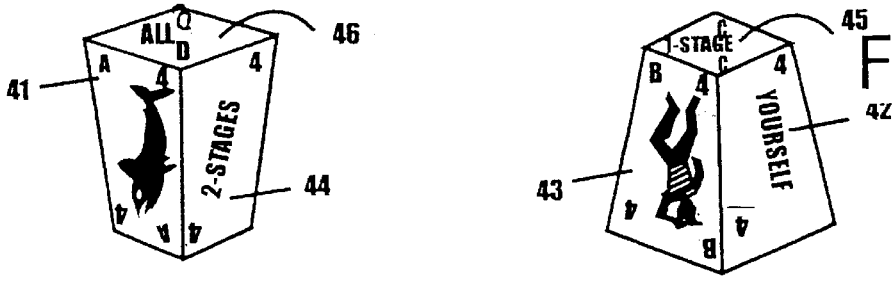

This Jacks game includes four plastic trapezoidal Jacks. Jack 10, Jack 20, Jack 30, Jack 40 and a rubber ball 99. Each Jack has six distinguishable faces and is presented as the bottom portion of a truncated pyramid. Therefore the four regular sides are not parallel and the bases are pretty well parallel. A view of FIG. 2A shows the four regular sides (faces) of Jack 10. They are: side 11, side 12, side 13, side 14, then smaller base 15, and larger base 16. While a view of FIG. 2B shows the sides of Jack 20. They are: side 21, side 22, side 23, side 24 and then the two bases: smaller base 25 and larger base 26. Further down in our drawing we can see clearly in FIG. 2C the sides of Jack 30. They are: side 31, side 32, side 33, side 34, smaller base 35 and larger base 36. When we consider FIG. 2D we see in Jack 40: side 41, side 42, side 43, side 44, smaller base 45 and larger base 46.

Figure 3A:
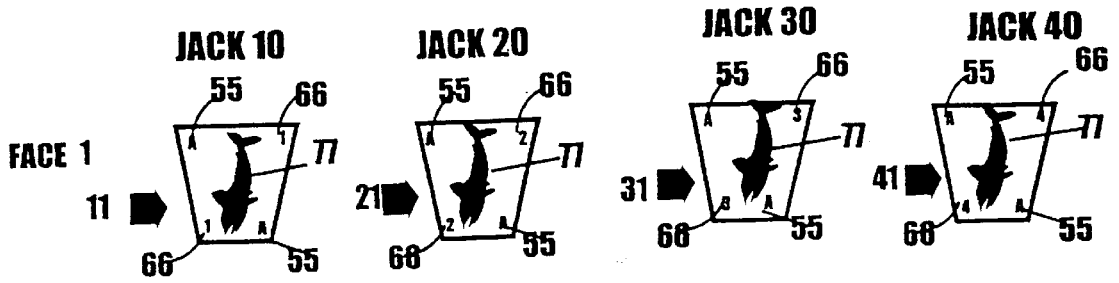
FIG. 3A through FIG. 3F show a perspective views of group arrangements of the six faces of all four Jacks according to the relative position of each face in the Jacks.

Place the four Jack in front of you in a surface plane so to have Faces of sides 11, 21, 31, 41 as shown in FIG. 3A. All four Jacks are marked on their upper left corners and their lower right corners with literal indicia 55 "A" said indicia 55 determine the sequence in which the Jacks are to be picked up during the game. Their upper right and lower left corners are marked with numerical indicia 66. Said numerical indicia 66 differentiate each Jack from another Jack. In this way, we have four distinguishable Jacks. Jack 10, Jack 20, Jack 30 and Jack 40. Jack 10 has indicia 66 "1", Jack 20 has indicia 66 "2". Jack 30 has indicia 66 "3". Jack 40 has indicia 66 "4". In the faces 11, 21, 31, and 41 is placed suit 77. In this case suit 77 is a fish. It has been chosen arbitrarily.

Figure 3B:
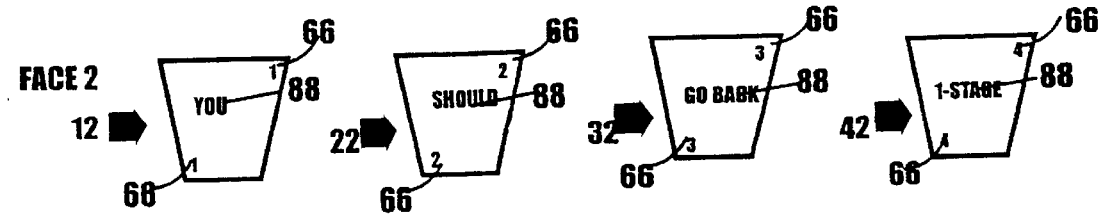

Let's turn the Jacks to their next possible right faces we have. Faces 12, 22, 32, 42 as shown in FIG. 3B. Face 12 has word 88 "YOU" in it's center. Face 22 carries word 88 "SHOULD". Face 32 contains words 88 "GO BACK" and face 42 is marked with word 88 "2-STAGES". Grouping these words 88 give the sentence "YOU SHOULD GO BACK 2 STAGES". These sides do not contain literal indicia 55. They do not follow the regular sequence of the game. They are created to complete among themselves that sentence or to be interchanged with other words 88 in any combinations so to form different sentences that give different instructions.

Figure 3C:
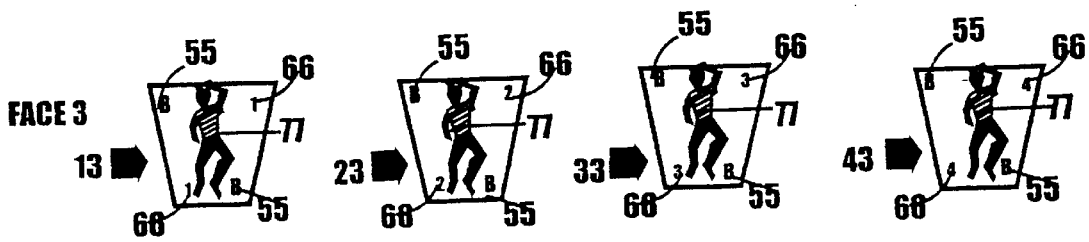

If we turn the Jacks another time to their next right faces we have the Faces as shown in FIG. 3C. We can see Faces 13, 23, 33, 43. The disposition of the markings in these faces are similar to FIG. 3A. The upper left corners and lower right corners are marked with literal indicia 55 "B". The upper right corners and lower left corners are marked with numerical indicia 66 "1", "2", "3" or "4". And the central portions are marked with suit 77. In this case said suit 77 is a dancer which has been chosen arbitrarily.

Finally, let's turn the Jacks to their last possible right sides. We immediately notice in FIG. 3D Faces 14, 24, 34, 44. The disposition of these sides is analogous to FIG. 3B. Face 14 is marked with word 88 "MAKE" in its center. Face 24 carries Word 88 "FUN" in its center. Face 34 has word 88 "OF" in its central portion. And, Face 44 is marked with Word 88 "YOURSELF". Together these words 88 form the sentence. "MAKE FUN OF YOURSELF". Like FIG. 3B, these sides do not follow the sequence of the game. They are created to be combined among themselves or to be interchanged with other words 88 to complete sentences that give instructions. These sides also do not carry literal indicia 55. But, like the other three regular sides, the upper right corners, and lower left corners are marked with numerical indicia 66: 1, 2, 3 or 4 which differentiate each Jack from any other Jacks.

Figures 3D, 3E, 3F:
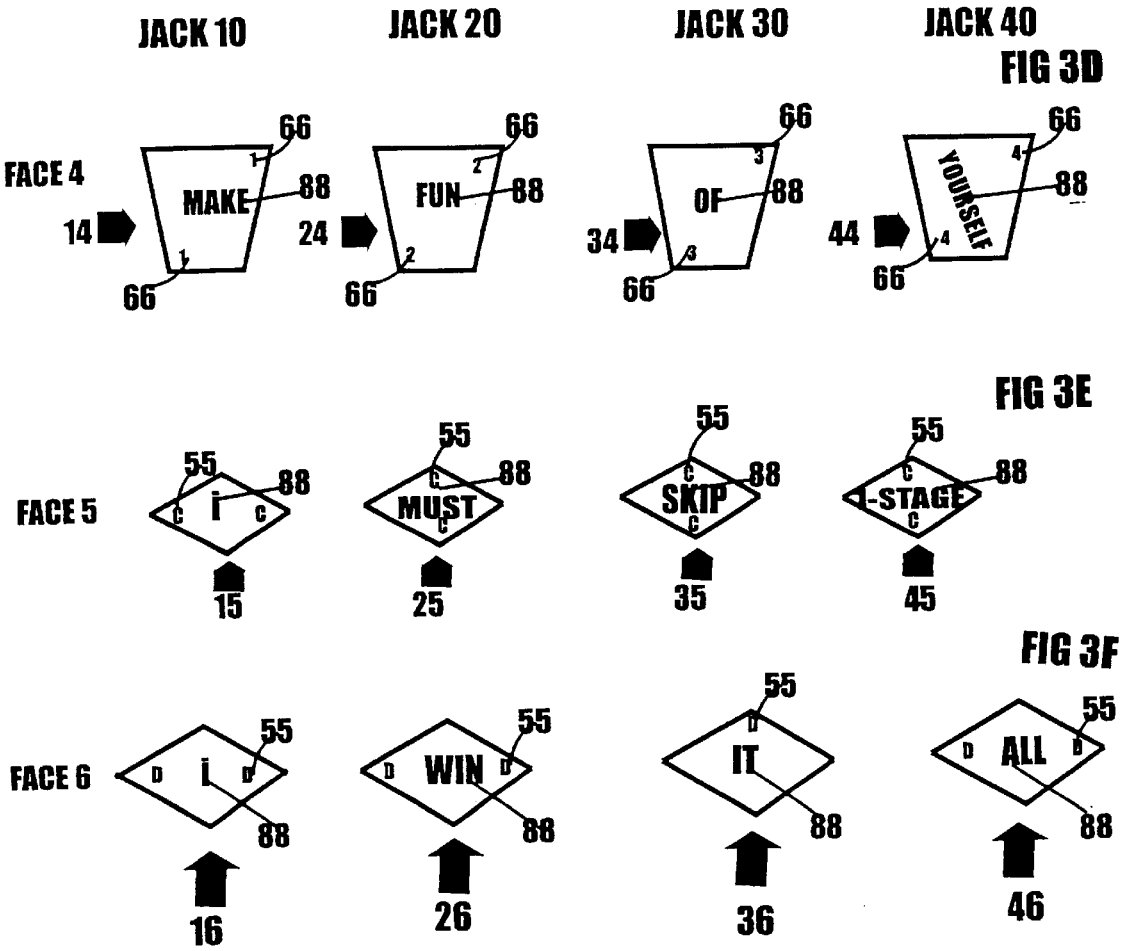

Now, let's imagine that we place the large bases of the Jacks over the plane surface and that we can see mostly the smaller bases as in FIG. 3E. Jack 10 has smaller base 15, Jack 20 has smaller base 25, Jack 30 has smaller base 35 and jack 40 has smaller base 45. Two opposite corners of each smaller base are marked with literal 55 "C" which indicate that this is the sides to be faced up and picked after the "B" sides in the regular sequence of the game. Smaller base 15 has the word 88 "I"in its center. Smaller base 25 is marked with word 88 "MUST". Smaller base 35 carries word 88 "SKIP" and smaller base 45 has word 88 "1-STAGE". Combine they form the sentence "I MUST SKIP 1-STAGE." Unlike the regular sides, smaller bases are not marked with numerical indicia 66.

The final side of the Jacks consists in flipping the Jacks so we can imagine only the large bases up like in FIG. 3F. Jack 10 has larger base 16, Jack 20 has larger base 26, Jack 30 has larger base 36 and Jack 40 has larger base 46. The disposition of the markings in the larger bases is analogous to the smaller bases. Two opposite corners are marked with literal Indicia 55 "D", which explains that this is the stage after the "C" stage in the regular sequence of the game. The central portion of larger base 16 is marked with word 88 "I". Central portion of larger base 26 contains word 88 "WIN" central portion of larger base 36 carries word 88 "IT" and central portion of large base 46 has word 88 "ALL". Combine in a sentence they form "I WIN IT ALL". Like smaller bases, larger bases are not marked with numerical indicia 66.

Beside the Jacks, the invention also includes rubber ball 99 approximately one inch in diameter. Ball 99 is the catalyst of the game. Jacks must be picked up between bounces of ball 99.

Figure 4:
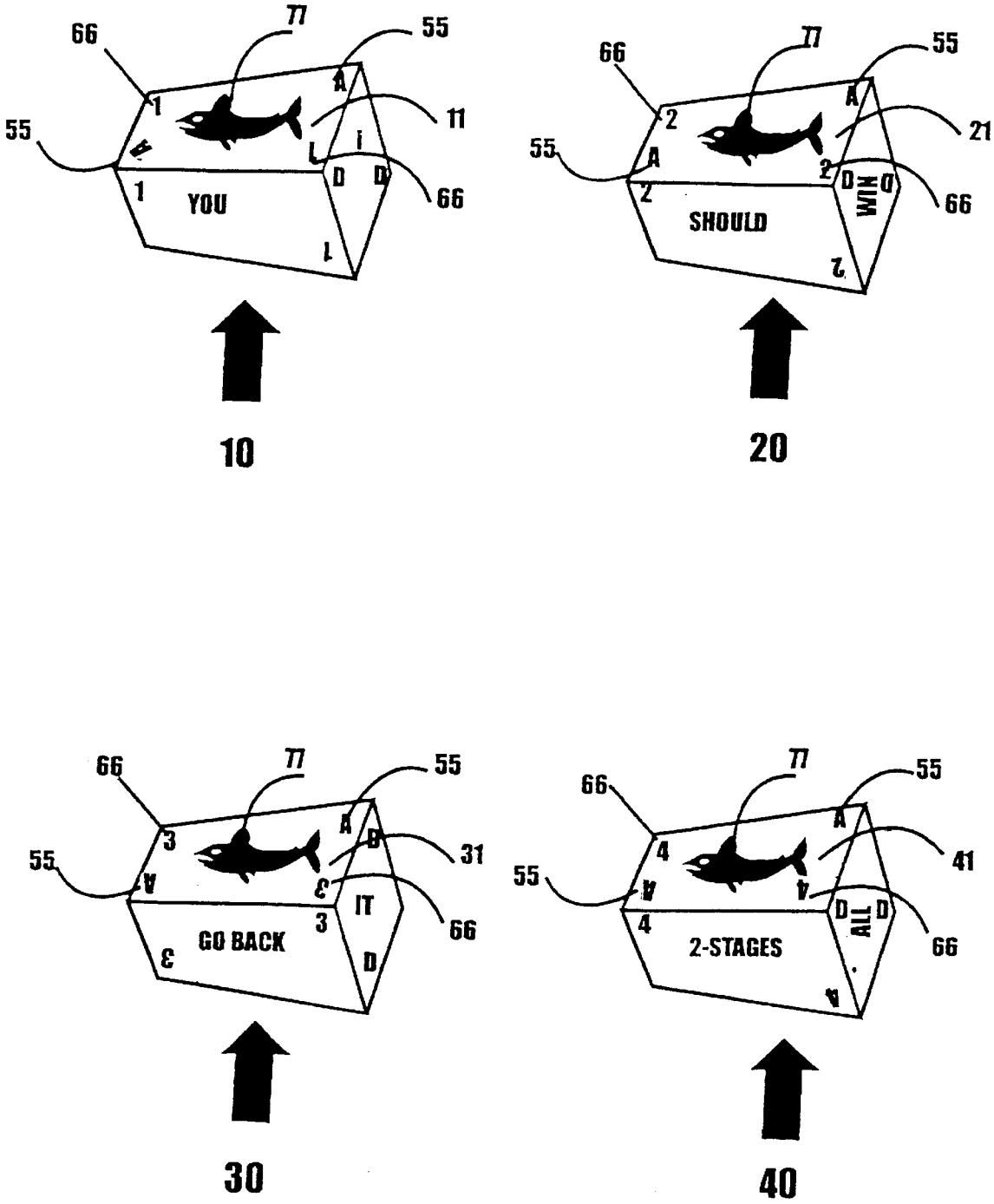
FIG. 4 is a perspective view of the four Jacks during the first step of the first stage of the game. The trapezoidal Jacks are faced up, ready to be picked.

The game begins with a player holding all four trapezoidal Jacks in one hand. Turn hand over and gently drop Jacks onto playing surface. The object of the game is to drop ball 99, pick up the Jacks then catch ball 99 with the same hand. Let ball 99 hit surface only once. There are four stages in the game designated by four literal indicia 55: A, B, C and D. The player needs to start with the side carrying indicia 55A, as shown in FIG. 4, then indicia 55 B, works his/her way up to indicia 55 C and to the final stage indicia 55"D". If there is no indicia 55 A-faced Jack, then the player must flip the Jacks onto the indicia 55 "A", catch ball 99, drop ball 99 back, and then pick up the Jack and then catch ball 99 once again. Dropping ball 99 once again he/she then pick up another indicia 55 A-faced Jack. This process continues for each of the four Jacks. If the player fails to catch ball 99 or handle Jacks accordingly, then, he/she loses his/her turn and must turn over Jacks and ball 99 to the next player. The rule of dropping the Jacks and ball 99 applies throughout the remainder of the game.

Figure 5:
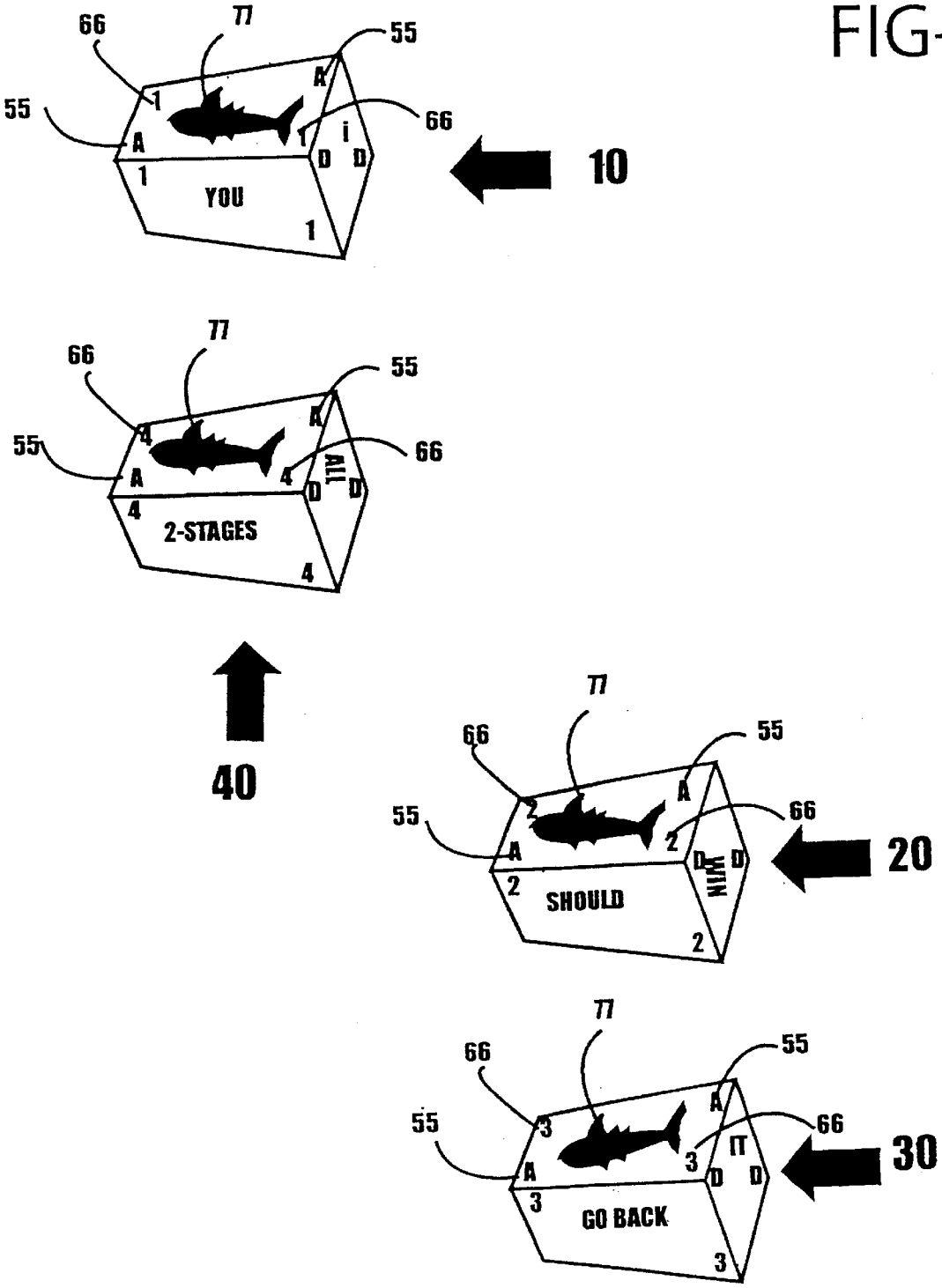
FIG. 5 show the four Jacks of the invention during the second step of the first stage of the game. The trapezoidal Jacks are faced up, ready to be picked.

FIG. 5 explains very clearly the next challenge of the game which is to pick up a set of two indicia 55 A-faced Jacks. There are two two sets of indicia 55 A-faced Jacks in total.

If the player accomplishes this task, he/she must pick up an indicia 55 A-faced Jack as shown in FIG. 6, followed by a set of three indicia 55 A-faced Jacks.

Finally to complete the first stage of the game, the player must pick up all four indicia 55 A-faced Jacks in one gathering as shown in FIG. 7A.

The next stage will consist of the repetitions of this numerically increasing activity doing indicia 55 "B", then the player must do the same for indicia 55 "C" and finally he/she must go through this repetition for indicia 55 "D".

Figure 9A:
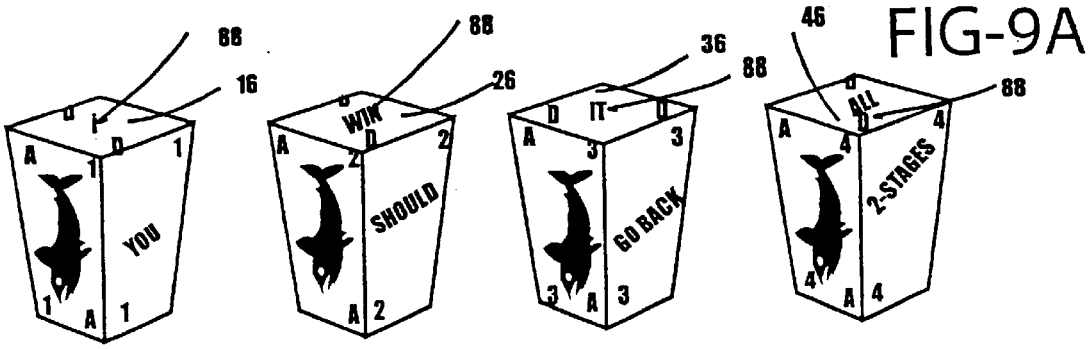
FIG. 9A through FIG. 9D show some possible arrangements of sentences formed with the words marked on the faces of the four Jacks.
Figure 9B:
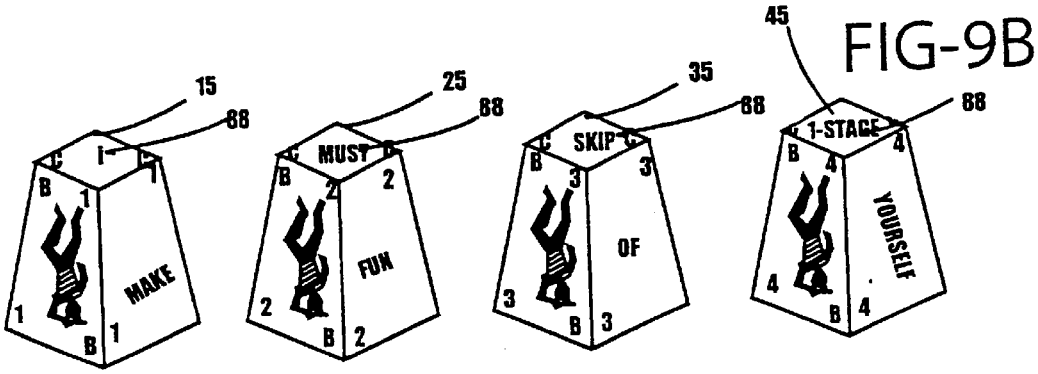
Figure 9C:
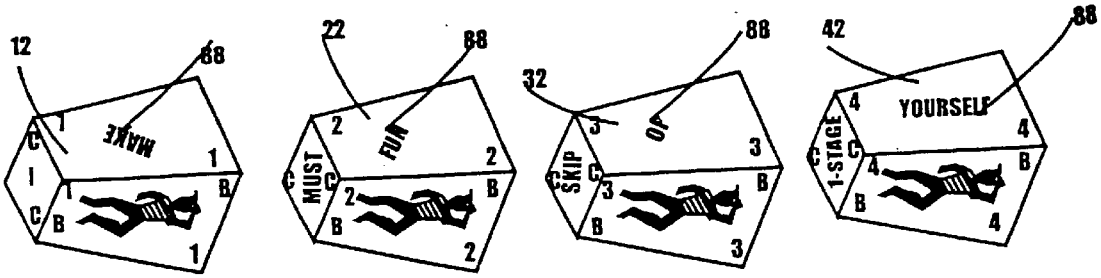
Figure 9D:
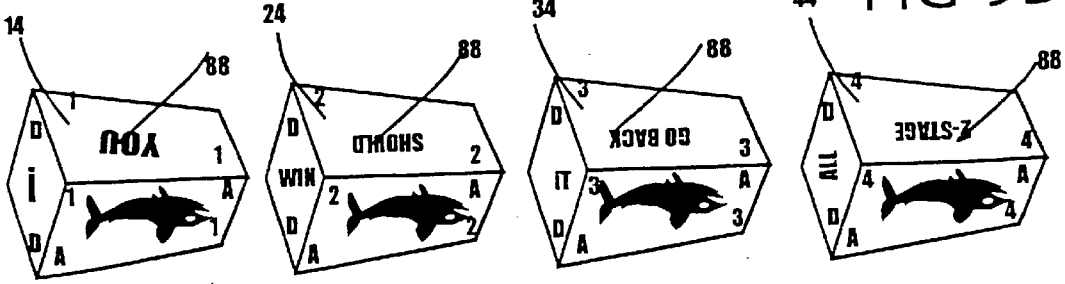

As we can see during the prior illustrations the game is very challenging and amusing. However, the most exciting part of the game happened in the reading of the sentences. The instructions being given by the Jacks can make a big difference in the players advancement. As an illustration, if we consider FIG. 9D. The Jacks read "YOU SHOULD GO BACK 2-STAGES." At this particular moment the opponent has to retract two stages. Let's say the opponent were expecting to pick four indicia "C" gathering in his turn, because of this instruction he/she must go back to four indicia "A" gathering. If instead the Jacks read "I SHOULD GO BACK 2 STAGES" the player that dropped the Jacks would be the one to stand with the consequences Combining words 88 many sentences can be formed. For example: in FIG. 9A we see "I WIN IT ALL", in FIG. 9B" I MUST SKIP 1-STAGE", FIG. 9C "MAKE FUN OF OF YOURSELF" and FIG. 9D "YOU SHOULD GO BACK 2-STAGES". These sentences are the original sentences. But words 88 could be interchanged in many ways to create multiple sentences and give instructions that add challenges to the game.

Figure 8A:
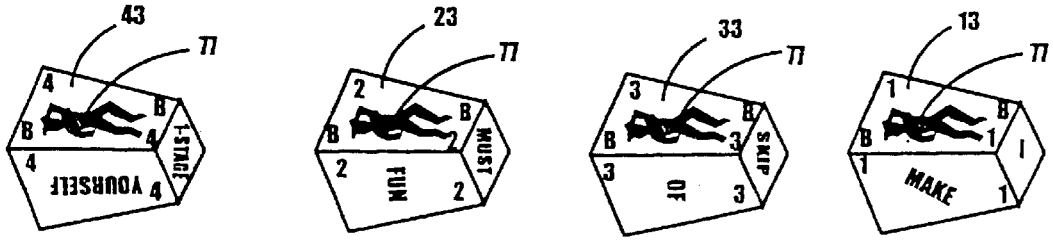
FIG. 8A and FIG. 8B are views of arrangements of the "SHIELDS" existing in the game.
Figure 8B:
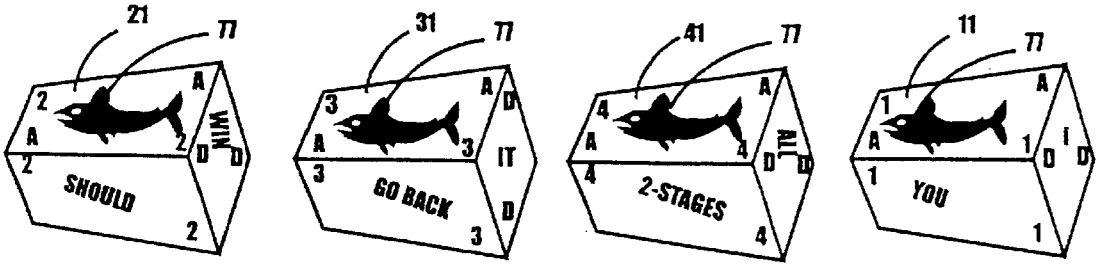

Though the instructions of the Jacks have power there have also their limit. FIG. 8A and FIG. 8B are called "SHIELDS". They are the shelters of players against certain instructions. Let's consider FIG. 8A. If the player that drops the Jacks have the four B-faced up he/she has one SHIELD and is protected against one unpleasant instruction. As an illustration, after a player have the SHIELDS, if the next drop the Jack read "YOU SHOULD GO BACK 1-STAGE", the player has the right to use that SHIELD not to follow this instruction. A player can gather as many SHIELDS possible for each game. It is not recommended to use a SHIELD without a good reason. Sometimes even if you have to go back, or to make fun of yourself, it is good to save the SHIELD for the last minute. For example if you drop the Jack while you working your "D" stage, if they read "YOU MUST SKIP 1-STAGE", the only redemption is a SHIELD. At that time the player would have to skip to A-faced stage which is just where he/she had started. In that particular moment, you can say "I am using my SHIELD" so as not to follow that instruction. The SHIELDS are only good for one game, the current one.

FIG. 8B is the reverse of FIG. 8A. If the player drops the Jacks and they show four A-faced he/she automatically cancels one of his/her opponent SHIELDS.

On the termination of a player's turn, the Jacks are passed to the next successive player until all players have played, and thereafter returned to the first player and the succession of turn is repeated. The game continues until a player gathers successfully the four D-faces in one gathering which is the last phase of the fourth stage of the game.

Although no exact method or material of fabrication is specifically described with the detailed description of the preferred embodiments of the invention, it will be apparent to those skilled in the art that various material and method consistent with the manufacturing of the games are available.

In a preferred embodiment, the Jacks are made sufficiently small to be picked all four in one gathering but large enough such that the numbers, the letters, the words and the suits displayed thereon can be easily seen. Furthermore, the Jacks are made of a hardened material to provide a high degree of performance without breaking. The ball could be formed of any suitable material.

It should be appreciated that although the present invention is depicted as embodying six-sided Jacks, Jacks may be used which bear any number of sides.

While the present invention has been described in connection with a single embodiment, it will be understood that many changes and modifications thereof may be made without departing from the true spirit and scope of the present invention, and it is intended by the expended claims to cover all such changes and modifications which come within the true spirit and scope of the invention.

What is claimed is:

1. A method of playing a game of jacks, comprising the steps of:

a. obtaining a plurality of jacks having a plurality of sides, wherein each of said sides comprises at least one instructive indicia that when read in combination with other said indicia on other said jacks possibly indicates a task to be performed, and wherein each of said jacks is sequentially numbered;

b. obtaining a ball;

c. placing said plurality of jacks in one hand;

d. dropping said plurality of jacks onto a surface;

e. reading said indicia facing upward from the surface;

f. performing the task indicated, if any, by the combination of all of said indicia;

g. bouncing said ball with one hand;

h. picking up at least one of said jacks with same one hand; and, i. catching said ball before it bounces a second time with same one hand.

2. The method of playing a game of jacks of claim 1, wherein one of said possible tasks formed by said instructive indicia is "YOU SHOULD GO BACK 2-STAGES".

3. The method of playing a game of jacks of claim 1, wherein one of said possible tasks formed by said instructive indicia is "I SHOULD GO BACK 2-STAGES".

4. The method of playing a game of jacks of claim 1, wherein one of said possible tasks formed by said instructive indicia is "YOU SHOULD GO BACK 1-STAGE".

5. The method of playing a game of jacks of claim 1, wherein one of said possible tasks formed by said instructive indicia is "I SHOULD GO BACK 1-STAGE".

6. The method of playing the game of jacks of claim 1, wherein one of said possible tasks formed by said instructive indicia is "I MUST SKIP 1-STAGE".

7. The method of playing the game of jacks of claim 1, wherein one of said possible tasks formed by said instructive indicia is "YOU MUST SKIP 1-STAGE".

8. The method of playing the game of jacks of claim 1, wherein one of said possible tasks formed by said instructive indicia is "I MUST SKIP 2-STAGES".

9. The method of playing the game of jacks of claim 1, wherein one of said possible tasks formed by said instructive indicia is "YOU MUST SKIP 2-STAGES".

10. The method of playing the game of jacks of claim 1, wherein one of said possible tasks formed by said instructive indicia is "I WIN IT ALL".

11. The method of playing the game of jacks of claim 1, wherein one of said possible tasks formed by said instructive indicia is "YOU WIN IT ALL".

12. The method of playing the game of jacks of claim 1, wherein one of said possible tasks formed by said instructive indicia is "MAKE FUN OF YOURSELF".

* * * * *